US006898398B2

(12) United States Patent
Omata et al.

(10) Patent No.: US 6,898,398 B2
(45) Date of Patent: May 24, 2005

(54) APPARATUS FOR IMAGE FORMING ON BOTH SIDES OF A RECORDING MEDIUM AND IMAGE FORMING METHOD, AND IMAGE CARRIER FOR THE SAME

(75) Inventors: Yasukuni Omata, Kanagawa (JP); Hideaki Mochimaru, Kanagawa (JP); Hisao Murayama, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 62 days.

(21) Appl. No.: 10/434,079

(22) Filed: May 9, 2003

(65) Prior Publication Data

US 2003/0235443 A1 Dec. 25, 2003

(30) Foreign Application Priority Data

May 9, 2002 (JP) ..... 2002-134391

(51) Int. Cl.[7] ..... G03G 15/00; G03G 15/01; G03G 15/16

(52) U.S. Cl. ..... 399/159; 399/302; 399/309

(58) Field of Search ..... 399/159, 162, 399/302, 306, 308, 309

(56) References Cited

U.S. PATENT DOCUMENTS

| | | | | |
|---|---|---|---|---|
| 5,258,813 A | | 11/1993 | Nakahara et al. | |
| 5,438,401 A | | 8/1995 | Murayama et al. | |
| 5,493,382 A | | 2/1996 | Takagaki et al. | |
| 5,541,029 A | | 7/1996 | Iwata et al. | |
| 5,604,575 A | | 2/1997 | Takagaki et al. | |
| 5,615,872 A | | 4/1997 | Mochimaru | |
| 5,737,680 A | | 4/1998 | Takagaki et al. | |
| 5,869,213 A | | 2/1999 | Iwata et al. | |
| 6,104,905 A | * | 8/2000 | Kondo et al. | 399/302 |
| 6,151,057 A | | 11/2000 | Yamazaki et al. | |
| 6,337,967 B1 | * | 1/2002 | Izumi et al. | 399/302 |
| 6,574,448 B2 | | 6/2003 | Mochimaru et al. | |
| 6,584,295 B2 | | 6/2003 | Omata et al. | |
| 6,763,211 B2 | * | 7/2004 | Yokoyama | 399/308 |

FOREIGN PATENT DOCUMENTS

JP 1-209470 8/1989

OTHER PUBLICATIONS

K. Mason, Research Disclosure, No. 327, p. 479, XP–000258675, "Optical Copier Using Backside Intermediate For Duplex", Jul. 1991.*

* cited by examiner

*Primary Examiner*—William J. Royer
(74) *Attorney, Agent, or Firm*—Oblon, Spivak, McClelland, Maier & Neustadt, P.C.

(57) ABSTRACT

A printer includes a transfer belt unit and an intermediate transfer belt. Two papers are fed into the printer one after another at a desired interval. 2nd and 4th images are transferred first onto the transfer belt unit and then onto back surfaces of respective papers. 1st and 3rd images are transferred by the intermediate transfer belt directly onto front surfaces of the respective papers. The 2nd and 4th images are formed on the transfer belt unit in such a manner that a distance between the two images on the transfer belt unit is set longer than the interval between the two papers.

16 Claims, 7 Drawing Sheets

APPARATUS FOR IMAGE FORMING ON BOTH SIDES OF A RECORDING MEDIUM AND IMAGE FORMING METHOD, AND IMAGE CARRIER FOR THE SAME

BACKGROUND OF THE INVENTION

1) Field of the Invention

The present invention relates to an apparatus and a method of forming an image on both sides of a recording medium.

2) Description of the Related Art

Image forming apparatuses like a copier, a printer, a facsimile and the like are made to form an image on both surfaces of a recording medium (hereinafter, "paper"). In a conventional image forming apparatus capable of recording on both surfaces of a paper, an image (visualized image) of one of the surfaces formed on an image carrier is transferred and fixed onto one surface (front surface) of the paper. The paper is then turned over by an arrangement, such as a passage, re-fed, and an image (visualized image) of the other surface formed on the image carrier is transferred and fixed on to the other surface (reverse surface) of the paper. This has been a prevalent method.

However, the recording on both surfaces by this method has left several issues concerning the reliability of paper transfer attributed to curling of a paper caused by fixing of an image on one surface and changing the transfer direction of paper.

In this context, Japanese Patent Application Laid-Open Publication No.1989-209470 discloses a method of fixing an image in one stroke after transferring a toner image on both surfaces of a paper using a first image carrier and a second image carrier.

According to this publication, a 1st image formed on a photoreceptor is transferred to a transfer belt by a first transfer device and a 2nd image formed on a photoreceptor is transferred directly onto one surface of the paper by the first transfer device. The 1st image is then transferred onto the other surface of the paper by a second transfer device, thereby achieving transfer of the images onto both the surfaces of the paper. This paper is then carried to a fixing unit for fixing the images.

However, according to the method published in this publication, the transfer belt is turned twice for recording on both surfaces of the paper. With this method there is a drawback that, productivity during continuous printing is declined, as the image formation starts after completion of one full turn of the transfer belt, before starting formation of the 2nd image.

SUMMARY OF THE INVENTION

It is an object of the present invention to solve at least the problems in the conventional technology.

The image forming apparatus according to one aspect of this invention has a continuous printing mode of forming one image on each of two surfaces of a plurality of recording media, the recording media being fed one after another at a desired interval. The image forming apparatus includes a first image carrier that carries a plurality of first images and a plurality of second images; and a second image carrier that carries a plurality of third images in such a manner that there is a desired gap between any two third images. The first image carrier transfers the first images as the third images onto the second image carrier and the second image carrier transfers the third images onto a first surface of a corresponding one of the recording media, and the first image carrier transfers the second images directly onto a second surface of the corresponding one of the recording media. A resultant of the gap, between any two third images, divided by a traveling speed of the second image carrier is greater than the interval between the recording media.

The image forming method according to another aspect of this invention is a method of forming one image on each of two surfaces of a plurality of recording media, the recording media being fed one after another at a desired interval. The method includes carrying a plurality of first images and a plurality of second images on a first image carrier; carrying a plurality of third images on a second image carrier in such a manner that there is a desired gap between any two third images; transferring the first images as the third images onto the second image carrier and transferring the third images onto a first surface of a corresponding one of the recording media; and transferring the second images directly onto a second surface of the corresponding one of the recording media. A resultant of the gap, between any two third images, divided by a traveling speed of the second image carrier is greater than the interval between the recording media.

The image carrier according to still another aspect of this invention, is mounted on an image forming apparatus, and carries a visualized image. The image carrier having a size which is suitable to accommodate two images at a time. Each size of the images is equal to a size of a recording medium, put in landscape orientation, whose long side is along a breadth of a recording medium of maximum size that can be passed through the image forming apparatus.

The other objects, features and advantages of the present invention are specifically set forth in or will become apparent from the following detailed descriptions of the invention when read in conjunction with the accompanying drawings.

DETAILED DESCRIPTION

Exemplary embodiments of the present invention will be explained below with reference to the accompanying drawings.

Figure 1:
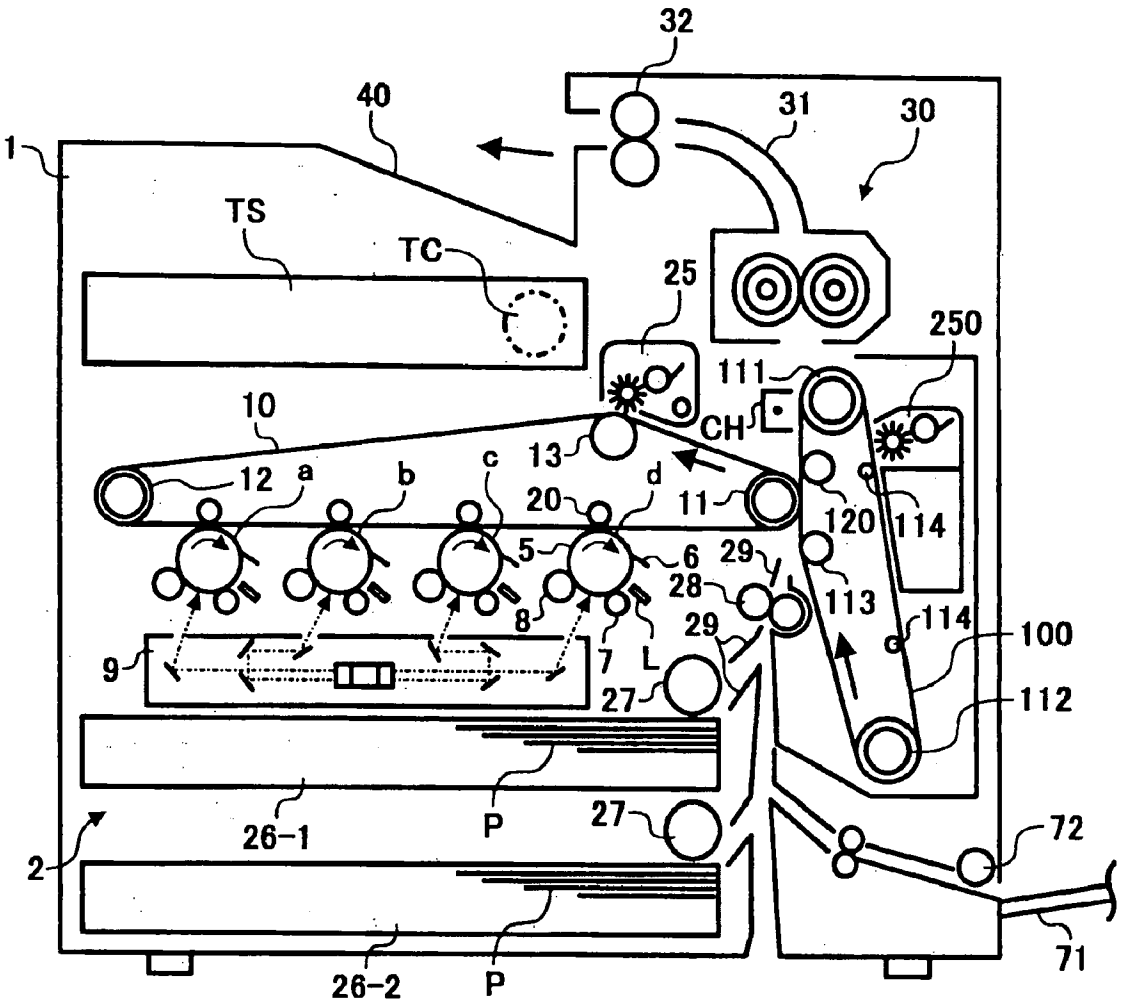
FIG. 1 is a sectional block diagram of an outline of a printer which is one of the examples of an image forming apparatus to which the present invention is applied.

FIG. 1 is a sectional block diagram of an outline of a printer, which is one of the examples of an image forming apparatus, to which the present invention is applied. The printer is, for example, a color printer. Reference numeral 1 denotes a printer main body, and a lower part of this printer main body 1 is provided with a paper feeding section 2. The paper feeding section 2 is equipped with a paper feeding tray 26-1 and a paper feeding tray 26-2, installed in two levels i.e., upper and lower stages. Approximately at the center of the main body 1, an intermediate transfer belt 10 is disposed as an image carrier put around rollers 11, 12, and 13. The intermediate transfer belt 10 is turned in a counterclockwise direction by roller 11, which is a drive roller, coupled to a driving unit, which is not shown.

Four imaging units a, b, c, and d are arranged along the lower running side of the intermediate transfer belt 10. Each of the imaging units a, b, c and d has a photoreceptor drum 5 disposed so as to be in contact with the intermediate transfer belt 10. A discharging unit L, a cleaning unit 6, a charging unit 7, and a developing unit 8 are arranged around the periphery of the photoreceptor drum 5. The photoreceptor drum 5 is driven in the direction of an arrow shown in FIG. 1 by a driving unit, which is not shown here. An exposing unit 9 is provided under the imaging units a, b, c, and d, and a laser beam is irradiated on the photoreceptor drum 5 at a position between the charging unit 7 and developing unit 8 as a writing position. The structure of all the imaging units a, b, c, and d is the same as each other but coloring material (toner) handled by each developing unit 8 is different.

The intermediate transfer belt 10 is a belt having a resistance with which toner can be transferred from the photoreceptor drum 5. For example, on a belt made of resin film or rubber as a substrate having a thickness between 50$\mu$m (micro-meter) to 500 $\mu$m, if a low surface energy coating is formed on a surface layer of the belt thereby raising a volume resistance from 106 Wcm (ohm-centimeter) to 1012 Wcm, the surface resistivity (W/sq) lies in the range of 105 to 1012. A transfer roller 20 is arranged on the inner side of the loop of the intermediate transfer belt 10 so as to face each of the imaging units a, b, c, and d. The transfer roller 20 serves as a device for transferring each toner image formed in the imaging units a, b, c, and d onto the surface of the intermediate transfer belt 10. Moreover, a cleaning unit 25 is disposed on the outer side of the loop of the intermediate transfer belt 10 and against the roller 13. This cleaning unit 25 removes unnecessary toner remaining on the intermediate transfer belt 10 after transferring of a toner image carried on the intermediate transfer belt 10.

On the left side of the main body 1, a transferred image carrying belt unit (hereinafter, "transfer belt unit") 100 is provided so as to vertically extend. The transfer belt unit 100 is an intermediate transfer body capable of carrying a toner image and the provision enables the printing on both surfaces of a paper as explained below. Two intermediate transfer bodies, the intermediate transfer belt 10 and the transfer belt unit 100, capable of carrying a toner image are provided. For simplicity, the intermediate transfer belt 10 may also be referred to as a first image carrier and the transfer belt unit 100 as a second image carrier.

The transfer belt unit 100 is put around rotating rollers 111, 112, and 113. The roller 111 is a drive roller and is driven by a driving unit (not shown) and rotates in the clockwise direction in the figure. A transfer roller 120 is disposed on the inner side of a loop of the transfer belt unit 100 and adjacent to the roller 11 supporting the intermediate transfer belt 10. The transfer roller 120 functions as a unit to transfer the toner image carried on the intermediate transfer belt 10 to a recording medium or the transfer belt unit 100. Apart from this, two backing rollers 114 are provided on the inner side of the loop. Moreover, a cleaning unit 250 for the transfer belt unit 100 and a charger CH are disposed on the outer side of the loop of the transfer belt unit 100. The charger CH transfers a toner image carried by the transfer belt unit 100 to the recording medium. The cleaning unit 250 removes the unnecessary toner remaining on the transfer belt unit 100 after the toner is transferred to a paper.

The intermediate transfer belt 10 and the transfer belt unit 100 come in contact with each other by the transfer roller 120, the roller 113, and the roller 11 supporting the intermediate transfer belt 10, thereby forming a required transfer nip.

The transfer belt unit 100 is heat resistant and besides this, has an electric resistance that enables transfer of toner from the intermediate transfer belt 10. The transfer belt unit 100 is made of a material like polyimide or polyamide-imide having a substrate thickness between 50 $\mu$m and 500 $\mu$m. The top surface of the transfer belt unit 100 is coated with a low surface energy material like fluorine and the volume resistance of the overall belt is made to be in the range of $10^6$ and $10^{12}$. The surface resistivity ($\Omega$/sq.) is in the range of $10^5$ to $10^{12}$.

A paper P is kept as a recording medium in the paper-feeding cassettes 26-1 and 26-2 of the paper feeding section 2. The uppermost paper is fed in by a feeding unit including a paper feeding roller 27 and then carried forward to a registration roller pair 28 through a plurality of guides 29.

A fixing unit 30 with a built in heat source like a heater, is provided on top of the transfer belt unit 100 and is followed by a discharge guide 31 and a discharge roller pair 32. The heat source of the fixing unit 30 is energized during the fixing process after paper P is carried forward.

A top surface of the apparatus is formed as a discharged paper stacking section 40. A storing section TS, consisting of 4 toner cartridges TC to be used for replenishment of toner, is provided between the discharged paper stacking section 40 and the intermediate transfer belt 10. The colors of toners in the toner cartridges TC are magenta, cyan, yellow, and black and they are replenished to the corresponding developing unit 8 by a powder pump not shown in the figure. The toner cartridges TC can be replaced by opening a cover on the discharged paper stacking section 40.

The image forming operation of this embodiment having the structure mentioned above is explained below.

To start with, an operation of the printer when printing images on both surfaces of a paper is to be explained.

The printer receives, from a host machine like a computer, a signal for writing. The exposing unit 9 is driven when the signal is received and radiates light from a laser light source (not shown). A polygon mirror, which is rotated by a motor, scans the light radiated from the laser light source. This light is then irradiated onto the photoreceptor drum 5, which is charged uniformly by the charging unit 7, and a latent image corresponding to the writing information (information of all color images which are color separated) is formed on the photoreceptor drum 5.

The latent image formed on the photoreceptor drum 5 is developed by the developing unit 8 to give a toner image. This toner image is formed and held on a surface of the corresponding photoreceptor drum 5. This toner image is transferred by the transfer roller 20 to the intermediate transfer belt 10 which is moving in synchronization with the photoreceptor drum 5. The toner remaining on the photoreceptor drum 5 after the toner image is transferred, is cleaned by the cleaning unit 6 and thereafter the discharging of the photoreceptor drum 5 is carried out by the unit L to prepare the photoreceptor drum 5 for the next imaging cycle.

The intermediate transfer belt 10 carries the toner image transferred from the photoreceptor drum 5 of the imaging unit a on the top surface of the intermediate transfer belt 10, and moves in the direction of the arrow shown in FIG. 1. A latent image corresponding to a different color is written on the photoreceptor drum 5 of the imaging unit b, and is developed by a toner of the corresponding color and becomes a toner image. This image is superimposed on the previous color toner image on the intermediate transfer belt 10, and toner images of four colors formed in the imaging units a, b, c, and d are thus superimposed to form a full color image.

The transfer belt unit 100 moves in synchronization with the intermediate transfer belt 10. The directions of rotation of the intermediate transfer belt 10 and transfer belt unit 100 have been shown with arrows in FIG. 1. When a toner image carried on the surface of the intermediate transfer belt 10 reaches the transfer area, this toner image is transferred to the surface of the transfer belt unit 100 due to the action of the transfer roller 120. This image carried on the transfer belt unit 100, is called a back surface image for the sake of convenience. The back surface image transferred to the transfer belt unit 100, completes one turn while being carried on the transfer belt unit 100 which is turning in clockwise direction in the figure. The back surface image then moves toward the position where the intermediate transfer belt 10 and the transfer belt unit 100 come in contact with each other.

Similarly, the toner image which is a top surface image, is transferred by superimposing and carried on the intermediate transfer belt 10. When this top surface image moving by the intermediate transfer belt 10 reaches the transfer area, this top surface image synchronizes with the back surface image already transferred to the transfer belt unit 100, and a paper P from the feeding section 2 or a manual feeding tray 71, is fed through the registration roller pair 28. When the paper P reaches between the intermediate transfer belt 10 and the transfer belt unit 100, the toner image of the top surface image carried on the intermediate transfer belt 100 is transferred by the transfer roller 120 to one surface of the paper P. At the same time the back surface image already transferred to the transfer belt unit 10 is superimposed on the other surface of the paper P.

Further, the paper P is carried to the upper side, and the toner image of the back surface image carried on the transfer belt unit 100 is transferred to the other surface of the paper P by the charger CH.

The speed with which the paper P is fed (hereinafter, "paper feeding speed") by the paper feeding roller 27 and a paper feeding roller 72 is the same as a paper feeding speed by the registration roller pair 28. The paper feeding speed is the speed of the intermediate transfer belt 10 and the transfer belt unit 100. In other words, this speed is the same as the traveling speed of the image carried on the intermediate transfer belt 10 and transfer belt unit 100. For the printer explained here, the paper feeding speed is equal to the traveling speed of an image and this speed is set to 150 mm/sec (millimeter per second). For transferring the toner image from the intermediate transfer belt 10 or the transfer belt unit 100 to the paper P, the paper P is carried forward while adjusting the timing of the registration roller pair 28 so that the image on the paper P is in normal position.

In this embodiment, the polarity of toner to be imaged on each of the photoreceptor drums 5 in the four imaging units a, b, c and d is negative. The toner image created on the photoreceptor drum 5 is transferred to the intermediate transfer belt 10 by applying a positive charge on the transfer roller 20. Besides, by applying a positive charge to the transfer roller 120, the toner carried on the intermediate transfer belt 10 is transferred to the transfer belt unit 100 or to one of the surfaces of a paper P. Furthermore, by applying a charge having a positive polarity from the charger CH to the transfer roller 120, the toner image of a negative polarity on the top surface of the transfer belt unit 100 is attracted and transferred to the other surface of the paper P.

Thus, the paper P which has a toner image transferred on both top and back surfaces, is forwarded to the fixing unit 30. The toner images on both surfaces of the paper P are fixed at the same time and the paper P is discharged to the discharged paper stacking section 40 by the discharge roller pair 32 through the discharge guide 31.

If the discharged paper stacking section 40 is constructed as shown in the figure, a surface of the paper P on which an image of double-sided images is transferred directly from the intermediate transfer belt 10, is the surface facing downward when stacked in the discharged paper stacking section 40. Therefore, to collate pages, the following steps may be performed. That is, an image for a 2nd page is first formed, this toner image is held on the transfer belt unit 100, and thereafter, the image for the 1st page is directly transferred to the paper P from the intermediate transfer belt 10.

A top surface image transferred from the intermediate transfer belt 10 to the paper P is changed to a normal image on the surface of the photoreceptor drum 5. A back surface image transferred from the transfer belt unit 100 to the paper P is exposed on the photoreceptor drum 5 such that it becomes a reverse image (mirror image).

This order of forming images for collating pages has been realized by a known technique of storing image data in memory. Besides, exposure to change over between the normal image and the reverse image (mirror image) has also been realized by a known image processing technique.

On the other hand, to acquire an image on one surface of a paper P in this embodiment, there is no need to transfer an image to the transfer belt unit 100, but an image carried on the intermediate transfer belt 10 may be directly transferred onto the paper P. However, if an image is to be acquired on the top surface of a paper P before discharging the paper P to the discharged paper P stacking section 40, in a case of single-sided printing, it is also possible to transfer an image on the top surface of a paper P through the transfer belt unit 100.

The maximum size of a paper P which can be used in a printer in this embodiment, is "A3 in portrait orientation", and it is obvious that the transfer belt unit 100 has a loop long enough to carry a toner image corresponding to "A3 in portrait orientation". Besides this, in order to improve the productivity while using A4 size paper, which is used very frequently, the length of the transfer belt unit 100 is set such that two toner images ("duplex mode") each corresponding to "A4 in landscape orientation" can be carried on the transfer belt unit 100. More specifically, the distance between the two images in a case of employing the duplex mode for size A4 in landscape orientation ("in landscape") is set to 45 mm, and the length of the transfer belt unit 100 is 510 mm obtained through the following equation:

$$(A4 \text{ in landscape})\times 2+(\text{interval between two images})\times 2.$$

Whereas, the time interval between two papers fed by the paper feeding section 2 or the manual feeding tray 71, is 0.2 second. In other words, the 2nd paper is fed 0.2 second after the 1st paper is sent forward by the paper feeding roller 27 or the paper feeding roller 72. If this time interval between two papers fed is converted to distance (between two papers), becomes 30 mm. Therefore, the interval between two images, when a plurality of images are carried on the transfer belt unit 100, is greater than the interval between two papers. Here, the intervals are expressed as interval between two images and interval between two papers since the traveling speed of the transfer belt unit 100 is the same as the paper feeding speed of the paper feeding roller 27 and the paper feeding roller 72. However, in the present invention, the time obtained by dividing an interval between two images by the traveling speed of the transfer belt unit 100 may be greater than an interval (time) between two papers.

Further, for carrying a plurality of images ("multiple mode") of a size smaller than the "A4 in landscape", on the transfer belt unit 100, e.g., for carrying three images ("triplex mode") on the transfer belt unit 100 for "A6 in landscape (postal card in landscape)", the distance between two images is set to 45 mm. However, in such a case, the distance between the last image and the 1st image is not necessarily 45 mm and this doesn't cause any problem.

Besides, the interval (distance) of 45 mm between two images on the transfer belt unit 100, is a distance between images formed and carried on the intermediate transfer belt 10 during continuous printing. That is, the imaging is to be controlled in such a way that the distance between the preceding image and the next image superimposedly transferred onto the intermediate transfer belt 10 from the imaging units (a to d) becomes 45 mm.

Thus, by carrying out an arrangement as mentioned in this example such that the interval between two images on the transfer belt unit 100 is greater than the interval between two papers when the paper feeding speed is equal to the image traveling speed, it is possible to carry out continuous printing with stable paper feeding during image forming by transferring an image onto the transfer belt unit 100.

That is, if the interval between images on the transfer belt unit 100 is equal to the interval between two papers, the interval between two images becomes less than the interval between two papers when the paper P is stopped at the registration rollers 28. This causes delay in paper feeding with respect to the image, from the 2nd paper onward during continuous printing. In order to overcome this delay, the paper feeding speed is to be accelerated by providing an intermediate roller. This results in destabilizing the paper feeding and making the control of each section difficult. However, in the present embodiment, the interval between two images on the transfer belt unit 100 is greater than the interval between two papers. Therefore, by stabilizing the paper feeding by keeping the speed of paper feeding constant, adjusting an image timing by stopping the paper P once at the registration rollers 28, and carrying out skew correction of the papers, it is possible to achieve high productivity in high quality double-sided printing.

Furthermore, the interval between two papers to be fed is 0.2 second, and if the interval (distance) of 45 mm between two images on the transfer belt unit 100 is 0.3 second when expressed in terms of time (when divided by image traveling speed of 150 mm/sec). In the case of employing the duplex mode for A4 in landscape, the 2nd paper is to be stopped for 0.1 second for position registration between the image and the paper P at the registration rollers 28.

Figure 2:
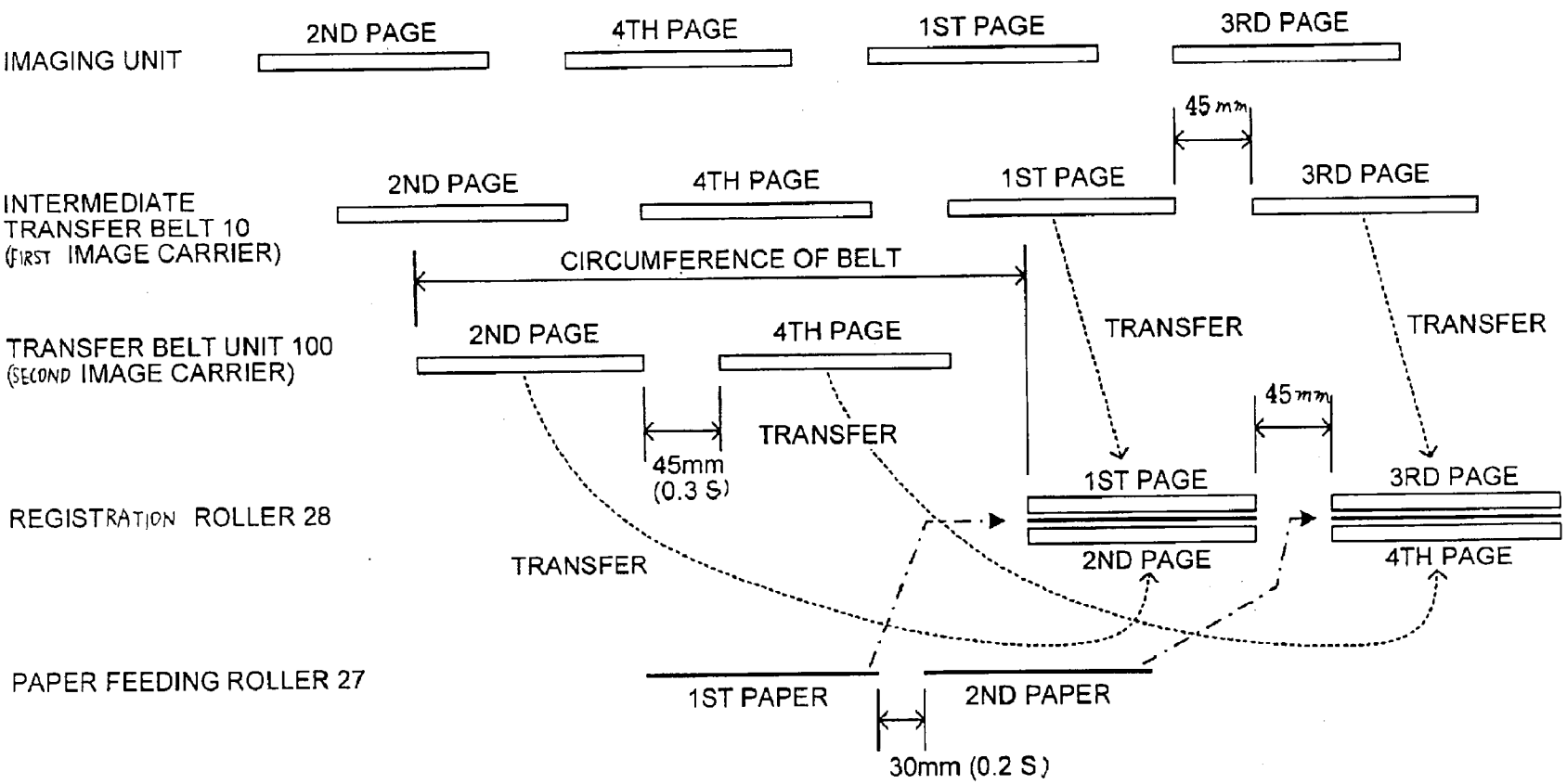
FIG. 2 is a schematic diagram that illustrates how images in a duplex mode are formed on a second image carrier of the printer.

FIG. 2 is a schematic diagram of a duplex mode on the second image carrier (transfer belt unit 100) in the printer of this embodiment. However, this figure gives a general idea of a relationship between an image interval and a paper interval. For the sake of understanding, explanation is given based on the length of a paper being the same as the length of an image (image area).

As shown in FIG. 2, in a case of a duplex mode in double-sided continuous printing, images, i.e. a color image obtained by superimposing single color images formed in each imaging unit a, b, c and d, formed in the imaging units (a to d) are in the order of 2nd page, 4th page, 1st page, and 3rd page as shown in the FIG. 2. The 2nd page image formed, is transferred from the intermediate transfer belt 10 to the transfer belt unit 100 followed by transferring of the 4th page image from the intermediate transfer belt 10 to the transfer belt unit 100. Thus, the transfer belt unit 100 carries thereon toner images for two pages. Next, the 1st and the 3rd page images formed are carried on the intermediate transfer belt 10 and travel towards the transfer area where the intermediate transfer belt 10 and the transfer belt unit 100 come in contact with each other.

At this point of time, the distance between the 2nd page image and the 4th page image on the second image carrier (transfer belt unit 100) is 45 mm. Similarly, the distance between the 1st page image and the 3rd page image on the first image carrier (intermediate transfer belt 10) is 45mm. On the other hand, the distance between two papers (a 1st and a 2nd paper) fed by the paper feeding roller 27 of the paper feeding section 2 is 30 mm (time interval between two papers is 0.2 second)-the 1st paper is sent forward by the registration rollers 28 so that the front tip of the 1st paper, the 1st page image on the intermediate transfer belt 10, and the 2nd page image on the transfer belt unit 100 coincide with each other.

The 1st page image and the 2nd page image are transferred to the top and back surfaces of the 1st paper. The 3rd page image and the 4th page image which are to be transferred to the 2nd paper, are carried on the intermediate transfer belt 10 and the transfer belt unit 100, respectively, and are traveling towards the transfer area. Each of the distances between the image and the preceding image on the respective belts is 45 mm as explained above. Although the distance between the 1st paper and the 2nd paper is 30 mm, stopping the 2nd paper for 0.1 second at the registration rollers 28 adjusts the distance between the two papers to 45 mm when the paper is sent forward from the registration rollers 28, thus making the distance the same as the distance between the images.

The 3rd page image and the 4th page image are transferred to the top and back surfaces of the 2nd paper by the intermediate transfer belt 10 and the transfer belt unit 100 respectively. It is needless to mention that the paper P is fed from the paper feeding section 2 anticipating the stopping time, since the 1st paper is stopped once at the registration rollers 28.

In FIG. 2, the case of a duplex mode for A4 in landscape during continuous printing is explained, but a similar approach can be taken for a multiplex mode in the case of smaller size paper. For example, in the case of a triplex mode on A6 size paper in landscape (length of paper along the direction of paper feed is 105 mm), a distance between two images is 45 mm, whereas a distance between two papers is 30 mm. The distance between two papers becomes 45 mm by stopping the 2nd paper by 0.1 second at the registration rollers 28. Furthermore, the position registration (timing) between a 3rd paper and the image is carried out by stopping the 3rd paper by 0.2 second at the registration rollers 28. Although the distance of 30 mm between the 2nd and the 3rd paper is reduced to 15 mm by stopping the 2nd paper at the registration rollers by 0.1 second, the distance between the two papers sent forward by the registration rollers becomes 45 mm as a result of stopping the 3rd paper by 0.2 second.

For printing in multiple mode on even smaller size paper, for example, printing four images for papers of business card size, malfunctioning caused due to the interference of a following paper with a preceding paper can be avoided by increasing the time interval (e.g. 0.25 second) between the two papers to be fed and changing the stopping time at the registration rollers 28 (e.g. 0.05 second for the 2nd paper, 0.1 second for the 3rd paper, and 0.15 second for the 4th paper).

Figure 3:
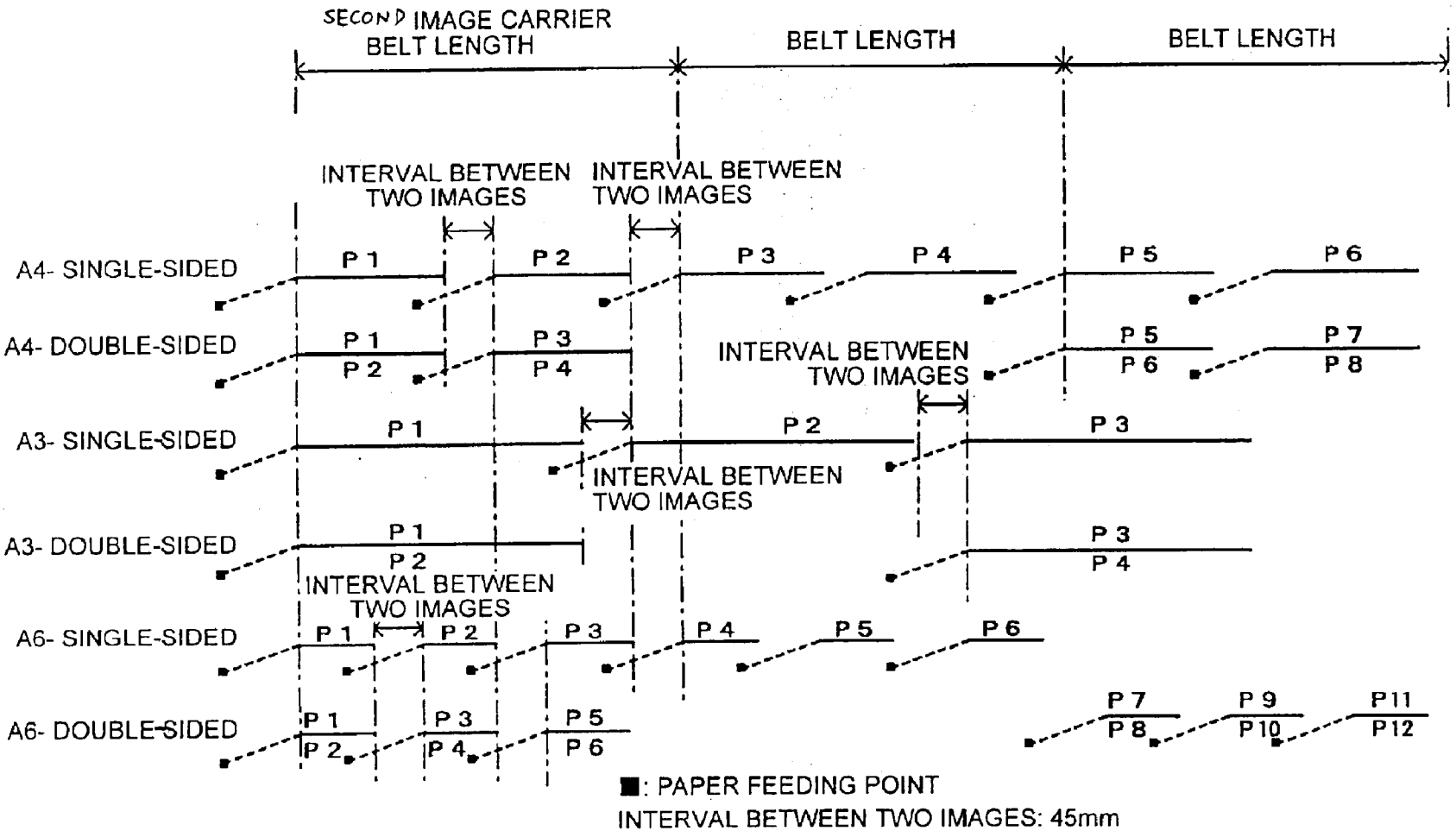
FIG. 3 is a schematic diagram that illustrates how page images are transferred to the surfaces of papers during continuous double-sided printing.

FIG. 3 is a schematic diagram of page images to be transferred on each surface of a paper during continuous double-sided printing. In this figure, horizontal lines of various lengths indicate different sizes of papers. Pages 'P1', 'P2' etc., on these lines, denote images to be transferred on papers from the intermediate transfer belt 10, and pages 'P2', 'P4' etc. denote images to be transferred on paper from the transfer belt unit 100. Marks of a black square represent paper-feeding points (timings). Explanation will be given based on a case where papers are stacked in such a manner that the papers are turned over and discharged in the order of page numbers.

In single-sided continuous printing on size A4 in landscape, images are formed in the order of page numbers and transferred onto the paper one after another from the intermediate transfer belt 10. The distance between two images is 45 mm and the distance between two pages which are sent forward from the registration rollers 28 also becomes 45 mm.

When images are formed in duplex mode on the transfer belt unit 100 for double-sided printing of size A4 in landscape, the order of forming images is P2, P4, P1, and P3 as shown in FIG. 2. Image P2 and image P4 are transferred from the transfer belt unit 100 to the paper, and image P1 and P3 are transferred from the intermediate transfer belt 10 to the paper. The distance between the images P2 and P4 on the transfer belt unit 100 is 45 mm and the distance between the images P1 and P3 on the intermediate transfer belt 10 is 45 mm as well. One revolution of the transfer belt unit 100 which carries images P6 and P8 to be transferred to the 3rd and 4th paper, is awaited. Therefore, there is a time vacant, equivalent to the total of interval between the images and circumference of the transfer belt unit 100 before the transfer of images (P5, P6) to the 3rd paper starts after transferring the images (P3, P4) to the 2nd paper.

In single-sided Continuous printing on size A3 in portrait orientation ("in portrait"), images are formed in the order of page numbers and these images are transferred from the intermediate transfer belt 10 to a paper one after another. The distance between two images on each page is 45 mm and the distance between two papers, when they are sent forward by the registration rollers 28, also becomes 45 cm. In the printer in this example, the order of image formation during single-sided continuous printing when the transfer belt unit 100 is not being used, is order of page numbers irrespective of size.

In the case of double-sided printing on A3 size in portrait, the images are formed in the order of P2, P1, P4, and P3. Since it is not possible to carry a plurality of pages on the transfer belt unit 100 for this double-sided printing, the image P4 which is formed in succession with the image P1, is transferred to the transfer belt unit 100. The image P4 after completing one revolution and the image P3 are transferred to the top and back surfaces of the 2nd paper.

In the case of single-sided continuous printing on size A6 in landscape, images are formed in the order of page numbers with the distance of 45 mm between the two images that is the same as the distance in the case of single-sided continuous printing on a paper of other size. The formed images are then successively transferred to papers.

When images are formed in a triplex mode on the transfer belt unit 100 for double-sided printing of size A6 in landscape, the order of forming the images is P2, P4, P6, P1, P3, and P5. The distance between the images P2, P4, and P6 is 45 mm and that between the images P1, P3, P5 is 45 cm as well. After the formation of the image P5, the images P8, P10, P12 are formed in succession and then transferred to the transfer belt unit 100, and the transfer belt unit 100 completes one revolution. The images P7, P9, and P11 formed in succession are transferred to the intermediate transfer belt 10 and return after traveling. The images P7 and P8 are transferred to the top and back surfaces of the 4th paper, the images P9 and P10 are transferred to the top and back surfaces of the 5th paper, and the images P11 and P12 are transferred to the top and back surfaces of the 6th paper in succession.

In the printer of this example, when papers are discharged, in such a manner that the pages are collated, onto the discharged paper stacking section 40 on the top surface of the apparatus, images are formed in the order of page numbers in single-sided printing in which the image is not transferred to the transfer belt unit 100.

In double-sided printing, there are two cases in which images are formed in a multiplex mode on the transfer belt unit 100 and images are formed in a simplex mode on the transfer belt unit 100. To collate pages for double-sided printing in the simplex mode, images are formed in the order of odd numbers and even numbers interchanged like 2, 1, 4, 3, 6, 5 . . . of the page order (1, 2, 3, 4, . . .).

To collate pages during double-sided printing in the multiplex mode, the order of image formation changes according to the number of planes (number of images) carried on the transfer belt unit 100.

Firstly, in the case of forming images in a duplex mode, the images for pages 2 and 4 are formed first, corresponding to a 1st and a 2nd paper, and the formed images are transferred and held on the transfer belt unit 100. Thereafter, the images for pages 1 and 3 are formed and transferred to the intermediate transfer belt 10, and the formed images are transferred to the 1st and 2nd papers.

Then the images for pages 6 and 8 are formed in succession corresponding to a 3rd and a 4th paper followed by formation of images for pages 5 and 7. That is, 'n' is a positive integer, and two papers are formed as one-set. When printing is performed on papers of n-th set, images for even numbered pages out of the images for (4n−3)-th to 4n-th pages are formed in the order from a smaller page number thereof first, followed by image formation on odd numbered pages in the order from a smaller page number thereof. For example, when printing is performed on papers (9th and 10th) of the 5th set, images for pages from 17th page (4·n−3) to 20th page (4n) are formed. Therefore, the images for the even numbered pages 18 and 20 are formed in this order first, and the images for the odd numbered pages 15 and 17 are formed in this order later.

In the case of forming images in a triplex mode, n is a positive integer and one set includes three papers. When printing is performed on papers of the n-th set, images for even numbered pages out of images from (6n-5)-th to 6th pages are formed in the order from a smaller page number thereof. Thereafter, images for odd numbered pages are formed in the order from a smaller page number thereof. For example, when printing is performed on papers (13th, 14th, and 15th) of the 5th set, images for pages from 25th page (6'5-5) to 30th page (6'5) are formed. Therefore, the images for the even numbered pages 26, 28, and 30 are formed first in succession, and the images for the odd numbered pages 25, 27, and 29 are formed later.

The following case is considered. That is, 'm' and 'n' are positive integers, and one set includes 'm' number of papers when images are formed in "m'plex" (m images) mode for continuous double-sided printing. When printing is performed on papers of the n-th set, images for even numbered pages out of the images for pages from (2·m·n−2·m+1)-th page to (2·m·n)-th page may be formed first in the ascending order of page numbers and odd numbered pages may be formed later in the ascending order of page numbers.

For example, when forming images in a quadruplex mode, 'in' is equal to 4. When the 3rd set, i.e., 'n' is equal to 3, images are formed in the order from the (2×4×3-2×4+1)-th page to (2×4×3)-th page. That is, images for even pages out of the pages from 17th page to 24th page may be formed first in the ascending order (18, 20, 22, 24) of the page numbers, and these images are transferred to the transfer belt unit 100. Then, the images for odd pages may be formed in the ascending order (17, 19, 21, 23) of page numbers, and these images are transferred from the intermediate transfer belt 10 to the papers. The images for the pages 17 and 18 are transferred to the top and back surfaces of the 1st paper of the 3rd set (9th paper as a total number counted from the 1st set)-the images for the pages 19 and 20 are transferred to the top and back surfaces of the 2nd paper (10th paper as the total number)-the images for the pages 21 and 22 are transferred to the top and back surfaces of the 3rd paper (11th paper as the total number). In addition, the images for the pages 23 and 24 are transferred to the top and back surfaces of the 4th paper (12th paper as the total number)-these images are transferred to the surfaces from either the intermediate transfer belt 10 or the transfer belt unit 100, respectively.

Figure 4:
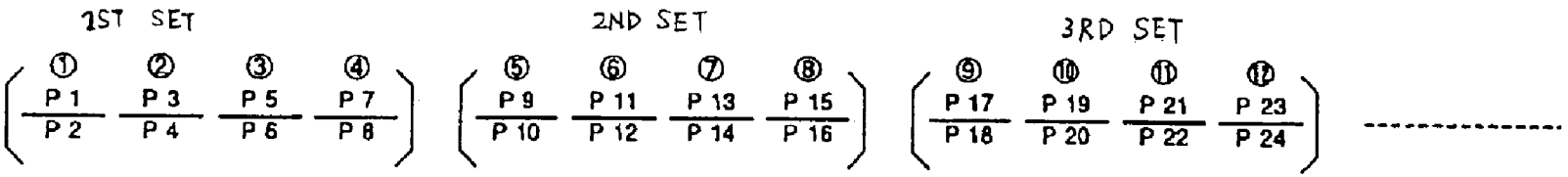
FIG. 4 is a schematic diagram that illustrates how images in a quadruplex mode are printed during continuous double-sided printing.

The continuous double-sided printing in this quadruplex mode is shown in FIG. 4. Horizontal lines in brackets denote papers, Px above and below these lines denote number of pages. Further, circled numbers denote numbers of papers from the head of the paper line up. Each paper is discharged in face down position in the order of circled numbers, and is piled up in the discharged paper stacking section 40 in the ascending order of the page numbers.

In continuous double-sided printing in the multiplex mode using the transfer belt unit 100, images are formed in the order of page numbers as mentioned above. Each image for an even numbered page is transferred to the paper through the transfer belt unit 100 (the second image carrier) and each image for an odd numbered page is transferred to the paper from the intermediate transfer belt 10 (the first image carrier)-this enables the stacking of papers in the order of page numbers when they are discharged in face down position.

Figure 5:
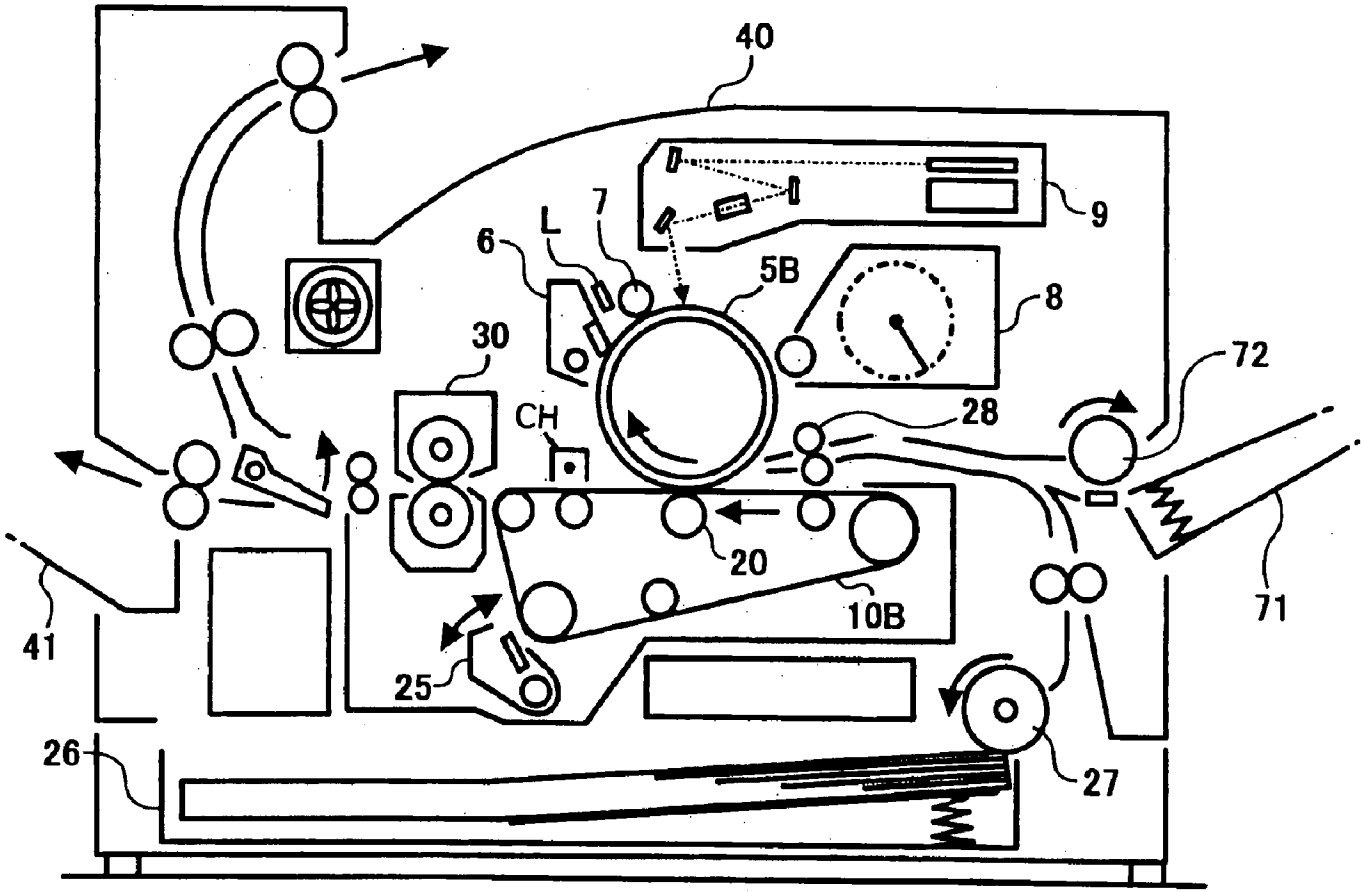
FIG. 5 is a sectional block diagram of one of the examples of a monochrome printer to which the present invention is applied.

The present invention can also be applied to a monochrome printer. FIG. 5 is a sectional block diagram of one example of a monochrome printer to which the present invention is applied. In this figure, the same reference numerals are assigned to the parts corresponding to or equivalent to those in the color printer in FIG. 1. However, in order to avoid any confusion in the explanation with that of the color printer in FIG. 1, suffix 'B' is added to the photoreceptor drum 5 and the intermediate transfer belt 10. As shown in FIG. 5, the discharging unit L, the cleaning unit 6, the charging unit 7, and the developing unit 8 are disposed around the periphery of the photoreceptor drum 5B.

The exposing unit 9 is provided above these units. The intermediate transfer belt 10B is provided in contact with the bottom of the photoreceptor drum 5B, and the transfer roller 20 is disposed on the inner side of the loop of the intermediate transfer belt 10B so as to be opposite to the photoreceptor drum 5B. The charger CH as a second transfer unit is disposed on the outer side of the loop of the intermediate transfer belt 10B. The monochrome printer in this example is provided with only one intermediate transfer belt 10B as an intermediate transfer body.

When a single-sided printed output is to be obtained using the monochrome printer in this example, a toner image formed on the photoreceptor drum 5B is transferred (by the action of the transfer roller 20) onto a paper which is fed by either the paper feeding cassette 26 or the manual feeding tray 71. In this case, when the paper is discharged in the discharged paper stacking section 40 on the top surface of the apparatus, the papers are stacked in face down position, and therefore the pages can be collated in the discharged paper stacking section 40 in continuous printing, by forming images in the order of page numbers.

When a double-sided printed output is to be obtained using the monochrome printer in this example, a toner image formed on the photoreceptor drum 5B is transferred to the intermediate transfer belt 10B (by the action of the transfer roller 20) and the next toner image is formed on the photoreceptor drum 5B. Thereafter, the toner images on the photoreceptor drum 5B and the intermediate transfer belt 10B are transferred on both sides of the paper which is fed from the paper feeding cassette 26 or the manual feeding tray 71 to obtain the double-sided printed output.

The transfer of the toner image from the intermediate transfer belt 10B to the paper is due to the action of the charger CH. In this case, to stack the double-sided printed outputs in the discharged paper stacking section 40 in such a manner that the pages are collated, images are formed in the order of odd numbers and even numbers interchanged like 2, 1, 4, 3, 6, 5, . . . of the order of page numbers (1, 2, 3, 4 . . . ). Moreover, the double-sided printing in this case is performed by forming an image in a simplex mode such that the intermediate transfer belt 10B carries an image only for one page.

Thus, the monochrome printer in this example has the photoreceptor drum 5B and the intermediate transfer belt 10B as image carriers which can carry toner images and transfer these toner images onto the paper. Hence, the photoreceptor drum 5B is called as a first image carrier and the intermediate transfer belt 10B is called as a second image carrier.

Normally, a reverse image (mirror image) is formed on the photoreceptor drum 5B, and by directly transferring this image onto the paper, a normal image is obtained. However, when the image transferred to the intermediate transfer belt 10B is to be transferred onto a paper, the image is obtained as a mirror image at the time of being transferred to the paper if the image is formed as the mirror image on the photoreceptor drum 5B. Therefore, the image transferred onto the paper from the intermediate transfer belt 10B, is formed as a normal image on the surface of the photoreceptor drum 5B and the toner image to be transferred directly from the photoreceptor drum 5B onto the paper is exposed so that the image becomes a mirror image on the surface of the photoreceptor drum 5B.

Figure 6:
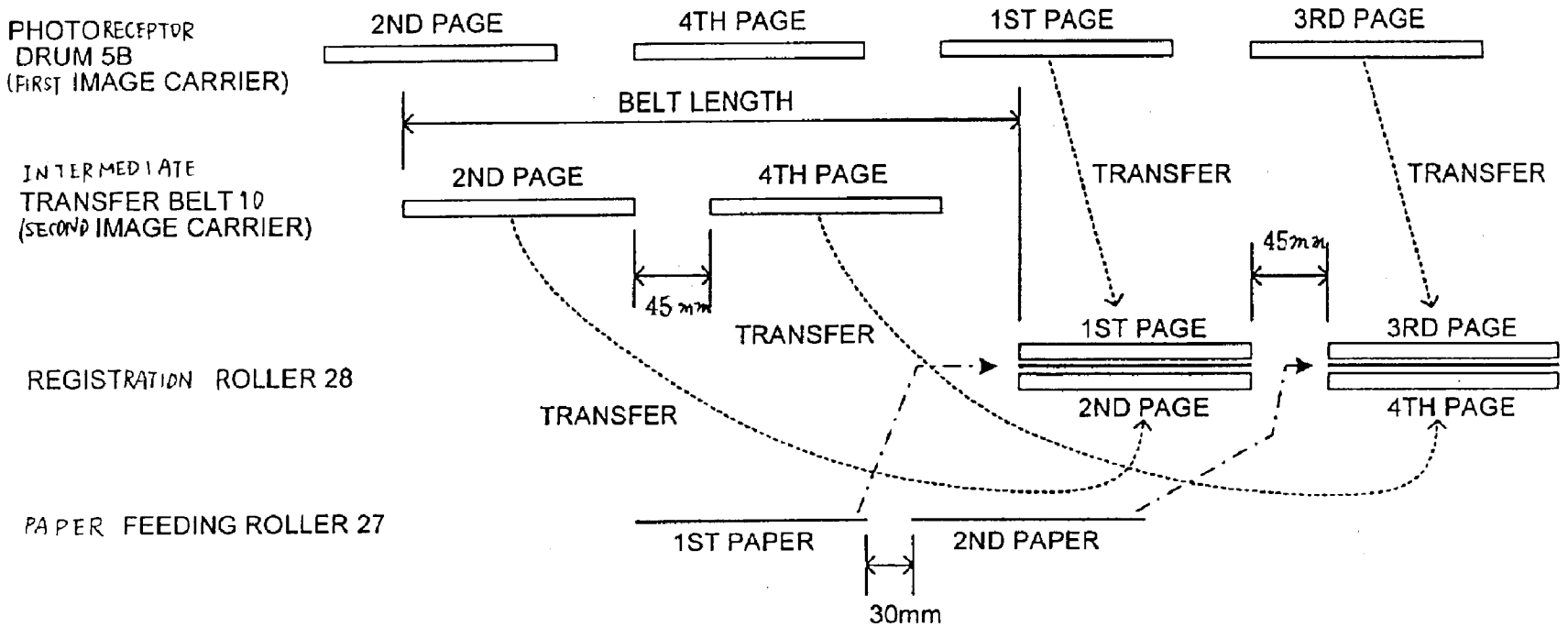
FIG. 6 is a schematic diagram that illustrates how images in a duplex mode are formed on a second image carrier of the monochrome printer.

Furthermore, even the monochrome printer in this example enables the continuous double-sided printing in multiplex mode in which a plurality of toner images for a plurality of pages are transferred onto the intermediate transfer belt 10B as the second image carrier. The operation during this continuous double-sided printing in multiplex mode is basically the same as that for the color printer in FIG. 1. As shown in FIG. 6, the operation may be carried out by transferring an image from the photoreceptor drum 5B as the first image carrier to one of the surfaces of the paper, and transferring an image from the intermediate transfer belt 10B as the second image carrier to the other surface of the paper, respectively.

Sometimes continuous double-sided printing is performed in multiplex mode by forming images on the intermediate transfer belt 10B of the monochrome printer in this example. In that case, to discharge papers into the discharged paper stacking section 40 so that the pages are collated, the images are formed in exactly the same order (order of preparing pages) as the case explained in FIG. 4.

Moreover, when the intermediate transfer belt 10B as the second image carrier carries a plurality of toner images for a plurality of pages, even in the monochrome printer of this example, the relationship between an image interval and a paper interval is the same as that in the color printer shown in FIG. 1. In this case, when the circumference of the intermediate transfer belt 10B is 510 mm, the distance between two images formed in multiplex mode is 45 mm and the distance between two papers is 30 mm. Further, the traveling speed of the photoreceptor drum 5B and the intermediate transfer belt 10B are set to 150 mm/sec which is equal to the paper feeding speed by the paper feeding rollers 27 and 72, and further by the registration rollers 28. Therefore, the interval between two papers to be fed is 0.2 second. In duplex mode, the 2nd paper is stopped at the registration rollers 28 by 0.1 second and the tip of the paper coincides with the tip of the image.

As shown in FIG. 5, the monochrome printer of this example has a discharged paper stacking tray 41 provided on the side face of the printer. When a paper is to be discharged to the discharged paper stacking tray 41, the paper is not turned over and discharged in face up position. Therefore, when the papers are to be discharged to the discharged paper stacking tray 41 so that the pages are collated, the order of image formation is different from that for the discharged paper stacking section 40 on the top surface of the printer.

That is, to discharge papers to the discharged paper stacking tray 41 so that pages are collated when images are formed in multiplex mode on the intermediate transfer belt 10B to perform the double-sided printing, a total number of pages becomes 2×m×n where 'm' and 'n' are positive integers. More specifically, the total number of 2×m×n is obtained by forming 'm' images on the intermediate transfer belt 10B for continuous double-sided printing and obtaining 'n' number of sets of printed outputs. For example, the number of double-sided printed outputs in three sets obtained in quadruplex mode is 24 pages in all. Further, even numbered pages are formed in descending order of page numbers by forming 2×m pages as one set, starting from the last even numbered page, and odd numbered pages are formed in descending order starting from the last odd numbered page. This is repeated 'n' times.

Figure 7:
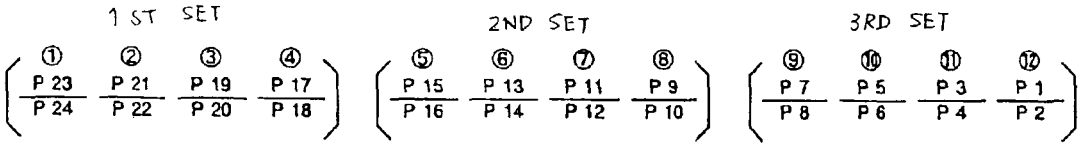
FIG. 7 is a schematic diagram that illustrates how images in a multiplex mode are printed during continuous double-sided printing when paper is discharged with a face up position.

FIG. 7 shows a case of three sets in quadruplex mode. The total number of pages is 2·m·n, i.e., 24 as shown in this figure. Images for all these 24 pages are made in three sets ('n' number of sets) with each set containing 2·m=8 pages. In the 1st set, images are formed in the descending order (P24, P22, P20, and P18) of page numbers of even numbered pages out of 8 pages from P24 to P17, and transferred to the intermediate transfer belt 10B. Next, images for odd numbered pages are formed on the photoreceptor drum 5B in the descending order (P23, P21, P19, and P17) of page numbers . Thereafter, images for the even numbered pages are transferred from the intermediate transfer belt 10B and images for the odd numbered pages are transferred from the photoreceptor drum 5B onto the top and back surfaces of four papers from 1st paper to 4th paper. At the same time, each image for the pages is formed on the photoreceptor drum 5B and transferred to the paper. Papers are discharged in face up position in the order of circled numbers and are stacked, and the pages of the papers when stacked in the discharged paper stacking tray 41 (FIG. 5) are collated.

Although in the examples of the color printer shown in FIG. 1 and the monochrome printer in FIG. 5, the image traveling speed (the traveling speeds of the first and second image carriers) is the same as the paper feeding speed, the present invention is not limited to the examples. The present invention is also applicable to cases where the image traveling speed (the traveling speeds of the first and the second image carriers) is different from the paper feeding speed (the paper feeding speed in the upstream side of the registration rollers). However, conditions of the applied cases are such that the paper feeding speed is to be kept constant and the paper feeding speed by the registration rollers 28 is equal to the image traveling speed.

For example, in FIG. 5, if the linear speed of the intermediate transfer belt 10B (and the registration rollers 28) is 150 mm/sec, then the paper feeding speed of the paper feeding rollers 27 and 72 is 180 mm/sec (this speed has to be constant). In such settings, when images are formed in duplex mode on the intermediate transfer belt 10B to perform continuous printing, the tip of the following image is traveling with delay of 0.3 second from the tip of the preceding image if the distance between the two images on the intermediate transfer belt 10B is 45 mm. On the other hand, if the (time) interval between the 1st paper and the 2nd paper fed by the paper feeding rollers 27 and 71, is 0.2 second (at this time, interval between two papers=distance is 36 mm), then the position registration between the image and the paper can be carried out by stopping the 2nd paper at the registration rollers 28 by 0.1 second. The 1st paper is started to be fed at a timing at which the paper is aligned with the header image considering the stopping time at the registration rollers 28.

Thus, even if the image traveling speed and the paper feeding speed differ from each other, the position registration between an image and a paper can be carried out by stopping the paper at the registration rollers 28 while stable feeding of the paper with a constant feeding speed is carried out. This constant feeding speed can be achieved by setting the interval between two images such that a value (time) obtained by dividing the interval by the image traveling speed is greater than the interval (time) between two papers to be fed. This position registration leads to stable image quality of continuous double-sided printing with high productivity. The same approach can be applied to the multiplex mode i.e., from the triplex mode onward.

Thus, when the paper feeding speed is faster than the image traveling speed, it is possible to have continuous double-sided printing with stability even for an apparatus having a structure in which the paper-feeding pass is long. Moreover, when a multi-stage cassette is provided in the paper feeding section, it is possible to obtain continuous double-sided printing with stable paper feeding speed.

Figure 8:
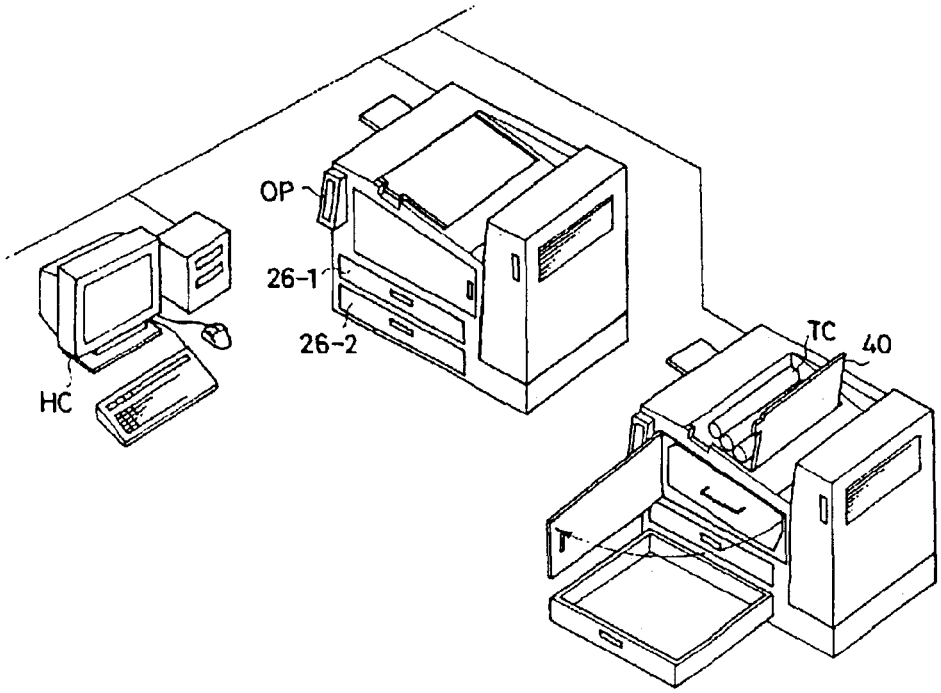
FIG. 8 is a perspective view of two color printers shown in FIG. 1 connected to a host computer through a network.

FIG. 8 illustrates a case in which two color printers of the type shown in FIG. 1 are connected to the host computer HC through a network. The color printers and a host computer may be connected to each other via wires or wireless. The reference numeral OP denotes an operation panel.

The present invention has been explained with the help of the embodiments shown in the figures, but the present invention is not only limited to these embodiments. For example, the interval between two images, image traveling speed (the linear speed of the first and the second image carrier), paper feeding speed, or the interval between two papers in the embodiments is just one example of this embodiment and these can be set to any suitable values. Similar is the case of the size of the second image carrier (width, length) and maximum size of the paper. The number of stages of the paper feeding cassettes is not limited to two. It is also possible to have a structure with more than two stages. Moreover, the structure of the imaging unit, the exposing unit or the fixing unit, developing unit, and the paper feeding section can also be done voluntarily. A copier or a facsimile can also be used instead of a printer as the image forming apparatus.

According to the image forming apparatus as one aspect of the present invention, continuous printing is carried out by transferring a plurality of images carried on a second image carrier, onto a plurality of recording media fed continuously. In this continuous printing, the interval between two images is set to a value such that the value (time) obtained by dividing the interval by the traveling speed of the second image carrier, is greater than the interval (time) between two papers as recording media to be fed. This setting enables the continuous printing with stable paper feeding, thereby giving high productivity and good quality.

Moreover, the second image carrier has a size suitable to carry two images at a time. Each of the images has a size equal to a recording medium, in landscape, whose long side is the short side of a maximum-sized recording medium that can be passed through the image forming apparatus. For example, if the maximum size of paper that can be passed through the apparatus is A3 in portrait, it is possible to improve the productivity of continuous printing using most frequently used A4 size paper in landscape.

Furthermore, since the traveling speed of the second image carrier and the feeding speed of the recording medium are equal, it is possible to structure and control the apparatus in a simple manner.

Moreover, since the feeding speed of the recording medium is faster than the traveling speed of the image carrier, it is possible to improve the productivity of any apparatus having long paper feeding paths or any apparatus provided with a multi-stage paper feeding cassette.

Furthermore, since it is possible to transfer images of different colors by superimposing them on a first image carrier, it is possible to acquire high productivity of continuous double-sided color printing.

Moreover, since the second image carrier is in the form of a belt, it is possible to have an image carrier which can carry a plurality of images (for a plurality of pages) by structuring simply and at low cost.

Furthermore, during continuous double-sided printing in a multiplex mode, it is possible to collate pages by discharging the recording media in face down position.

Moreover, during continuous double-sided printing in the multiplex mode, it is possible to collate pages by discharging the recording media in face up position.

According to the image carrier as another aspect of this invention, the image carrier has a size suitable to carry two images at a time. Each of the images has a size equal to a recording medium, in landscape, whose long side is the short side of a maximum-sized recording medium that can be passed through the image forming apparatus provided with the image carrier. Therefore, it is possible to improve the productivity of continuous printing.

The present document incorporates by reference the entire contents of Japanese priority document, 2002-134391 filed in Japan on May 9, 2002.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An image forming apparatus having a continuous printing mode of forming one image on each of two surfaces of a plurality of recording media, the recording media being fed one after another at a desired interval, comprising:

a first image carrier that carries a plurality of first images and a plurality of second images; and a second image carrier that carries a plurality of third images in such a manner that there is a desired gap between any two third images, wherein the first image carrier transfers the first images as the third images onto the second image carrier and the second image carrier transfers the third images onto a first surface of a corresponding one of the recording media, and the first image carrier transfers the second images directly onto a second surface of the corresponding one of the recording media, wherein a resultant of the gap, between any two third images, divided by a traveling speed of the second image carrier is greater than the interval between the recording media.

2. The image forming apparatus according to claim 1, wherein the second image carrier has a size which is suitable to accommodate two images at a time, a size of each of the images being equal to a size of the recording media, put in landscape orientation, whose long side is along a breadth of a recording media of maximum size that can be passed through the image forming apparatus.

3. The image fanning apparatus according to claim 1, wherein the traveling speed of the second image carrier is equal to a speed at which the recording media are fed.

4. The image forming apparatus according to claim 1, wherein a speed at which the recording media are fed is greater than the traveling speed of the second image carrier.

5. The image forming apparatus according to claim 1, further comprising an imaging unit that forms images of a plurality of colors on the first image carrier in superimposed manner.

6. The image forming apparatus according to claim 1, wherein the second image carrier is a belt.

7. The image forming apparatus according to claim 1, wherein when recording media are discharged in face down position to collate pages of the recording media during double-sided continuous printing in multiplex mode, assuming that the number of the third images carried at a time on the second image carrier is 'm', for papers in an 'n'-th set where one set consists of 'm' pieces of recording media, where 'm' and 'n' are positive integers, images for even numbered pages out of images for pages from $(2 \cdot m \cdot n - 2 \cdot m + 1)$-th page to $(2 \cdot m \cdot n)$-th page are fanned first on the first image carrier in an ascending order of page numbers and transferred on to the second image carrier, and images for odd numbered pages are formed later on the first image carrier in an ascending order of page numbers, thereafter the images for the even numbered pages formed first are transferred on to one of the surfaces of the recording media from the second image carrier, and the images for the odd numbered pages formed later are transferred on to the other surface of the recording media from the first image carrier.

8. The image forming apparatus according to claim 1, wherein when recording media are discharged in face up position to collate pages of the recording media during double-sided continuous printing in multiplex mode, assuming that the number of images carried at a time on the second image carrier is 'm' to obtain print outputs of an 'n'-th set where one set consists of 'm' pieces of recording media, where 'm' and 'n' are positive integers, images for even numbered pages in a set where one set consists of 2·m pages, are formed first on the first image carrier in a reverse order of page numbers i.e., in a descending order of page numbers and transferred on to the second image carrier, and images for odd numbered pages in the set are formed later on the first image carrier in a descending order of page numbers, thereafter the images for the even numbered pages formed first are transferred on to one of the surfaces of the recording media from the second image carrier, and the images for the odd numbered pages formed later are transferred on to the other surface of the recording media from the first image carrier, and this operation is repeated 'n' times.

9. An image forming method of forming one image on each of two surfaces of a plurality of recording media, the recording media being fed one after another at a desired interval, comprising:

carrying a plurality of first images and a plurality of second images on a first image carrier;

carrying a plurality of third images on a second image carrier in such a manner that there is a desired gap between any two third images;

transferring the first images as the third images onto the second image carrier and transferring the third images onto a first surface of a corresponding one of the recording media; and transferring the second images directly onto a second surface of the corresponding one of the recording media, wherein a resultant of the gap, between any two third images, divided by a traveling speed of the second image carrier is greater than the interval between the recording media.

10. The image forming method according to claim 9, wherein the traveling speed of the second image carrier is equal to a speed at which the recording media are fed.

11. The image forming method according to claim 9, wherein a speed at which the recording media are fed is faster than the traveling speed of the second image carrier.

12. The image forming method according to claim 9, further comprising forming images of a plurality of colors onto the first image carrier in a superimposed manner.

13. The image forming method according to claim 9, wherein when recording media are discharged in face down position to collate pages of the recording media during double-sided continuous printing in multiplex mode in which images for a plurality of pages are carried on a second image carrier, assuming that the number of images carried at a time on the second image carrier is 'm', for papers in an 'n'-th set where one set consists of 'm' pieces of recording media ('m' and 'n' are positive integers), images for even numbered pages out of images for pages from (2·m·n−2·m+1)-th page to (2·m·n)-th page are formed first on the first image carrier in an ascending order of page numbers and transferred on to the second image carrier, and images for odd numbered pages are formed later on the first image carrier in an ascending order of page numbers, thereafter the images for the even numbered pages formed first are transferred on to one of the surfaces of the recording media from the second image carrier, and the images for the odd numbered pages formed later are transferred on to the other surface of the recording media from the first image carrier.

14. The image forming method according to claim 9, wherein when recording media are discharged in face up position to collate pages of the recording media during double-sided continuous printing in multiplex mode in which a plurality of images are carried at a time on the second image carrier, assuming that the number of images carried at a time on the second image carrier is 'm' to obtain print outputs of an 'n'-th set where one set consists of 'm' pieces of recording media ('m' and 'n' are positive integers), images for even numbered pages in a set where one set consists of 2·m pages, are formed first on the first image carrier in a reverse order of page numbers i.e., in a descending order of page numbers and transferred on to the second image carrier, and images for odd numbered pages in the set are formed later on the first image carrier in a descending order of page numbers, thereafter the images for the even numbered pages formed first are transferred on to one of the surfaces of the recording media from the second image carrier, and the images for the odd numbered pages formed later are transferred on to the other surface of the recording media from the first image carrier, and this operation is repeated 'n' times.

15. An image carrier that is mounted on an image forming apparatus, and carries a visualized image, the image carrier having a size which is suitable to accommodate two images at a time, each size of the images being equal to a size of a recording medium, put in landscape orientation, whose long side is along a breadth of a recording medium of maximum size that can be passed through the image forming apparatus.

16. The image carrier according to claim 15, wherein the image carrier is a belt.

* * * * *